US005717176A

United States Patent [19]

Dahlstrom

[11] Patent Number: 5,717,176

[45] Date of Patent: Feb. 10, 1998

[54] SEQUENTIALLY OPERATED MEMBRANE SWITCHES

[75] Inventor: Jonathan Dahlstrom, Highland, Mich.

[73] Assignee: United Technologies Automotive, Inc., Dearborn, Mich.

[21] Appl. No.: 680,623

[22] Filed: Jul. 17, 1996

[51] Int. Cl.[6] ..... H01H 13/70

[52] U.S. Cl. ..... 200/1 B; 200/5 A; 200/512

[58] Field of Search ..... 200/1 R, 1 B, 200/5 A, 5 R, 512–517, 275

[56] References Cited

U.S. PATENT DOCUMENTS 4,376,238 3/1983 Martin ..... 200/1 B X 4,668,843 5/1987 Watanabe et al. ..... 200/5 A 5,559,311 9/1996 Gorbatoff ..... 200/1 B X

*Primary Examiner*—J. R. Scott

*Attorney, Agent, or Firm*—Howard & Howard

[57] ABSTRACT

An improved membrane switch includes multiple detents. A pair of electric circuits are completed by the membrane switch, and a pair of flexing portions are located on said membrane. A first flexing portion is overcome by a first lower insertion force to allow a first circuit to be complete, and a second flexing portion is only overcome by further insertion force. The second flexing portion is eventually overcome and completes a second circuit. The inventive membrane switch provides the operator with a clear indication and a detent feel for each of the two circuits.

16 Claims, 1 Drawing Sheet

SEQUENTIALLY OPERATED MEMBRANE SWITCHES

BACKGROUND OF THE INVENTION

This invention relates to a multiple detent membrane switch, wherein at least two electric circuits are completed with a single membrane switch.

Electrical switches are utilized in increasingly greater numbers in modern vehicles. The operator of a modern vehicle is provided with many different control options, and thus, more and more electric switches are required. Vehicle switches typically have included several different mechanical pieces, and assembly has been somewhat time consuming and costly. Moreover, the several piece mechanical switches have also sometimes been subject to failure.

As one example, there are known switches that can receive serial actuation to indicate different desired switch functions. Window switches are known wherein a first actuation of the switch causes the window to move completely upwardly or downwardly. A second serial actuation of the switch causes the window to stop at a desired intermediate location. This type of switch becomes quite complex and expensive to provide.

It is a goal of all vehicle assemblers to decrease the complexity and expense of the components. Thus, less expensive and complex electric switches are desired.

Membrane switches are known wherein a membrane has a relaxed position at which it holds two electric contact members out of contact. The membrane switch has a flexing area that can be overcome by an operator to allow the electric contacts to move together. Membrane switches have fewer working parts than the prior art mechanical switches, and thus have some desirable characteristics. However, the known membrane switches have only been utilized to actuate single circuits, and thus have been less widely utilized than may be desirable.

SUMMARY OF THE INVENTION

In a disclosed embodiment of this invention, a membrane switch includes at least two detents, or flexing areas, such that it can selectively complete at least two circuits. This invention will be disclosed with an embodiment including only two detents and circuits, but it should be understood that additional detents and circuits could be added. In inventive features of this application, the membrane includes two flexing portions, with a first flexing portion being overcome by an insertion force on a button such that a first circuit is completed. Upon a further insertion force from the operator, the second flexing portion is overcome and flexes to allow the second circuit to be completed.

Preferably, the second circuit is completed by electric contact elements positioned at a radially outer location on the membrane. In operation, an operator applies an insertion force to a switch button. The first flexing portion is first overcome, and the first contact member moves into contact with its mating contact in a circuit board. At that time, the first circuit is complete.

If the operator then desires to close the second circuit, further insertion force is placed on the switch button, and the second flexing portion is overcome. The second contact member then moves into contact with its mating contact member on the circuit board and the second circuit is completed.

The inventive multi-detent membrane switch provides distinct detent feel to the operator such that the operator is given a clear indication of when the first circuit is complete, and further when the second circuit is complete. This is important, as an operator only wishing to close the first circuit must have an indication of when sufficient insertion force has been placed on the switch such that the operator does not inadvertently close the second switch.

These and other features of the present invention can be best understood from the following specification and drawings, of which the following is a brief description.

DETAILED DESCRIPTION OF THE PREFERRED EMBODIMENT

Figure 1:
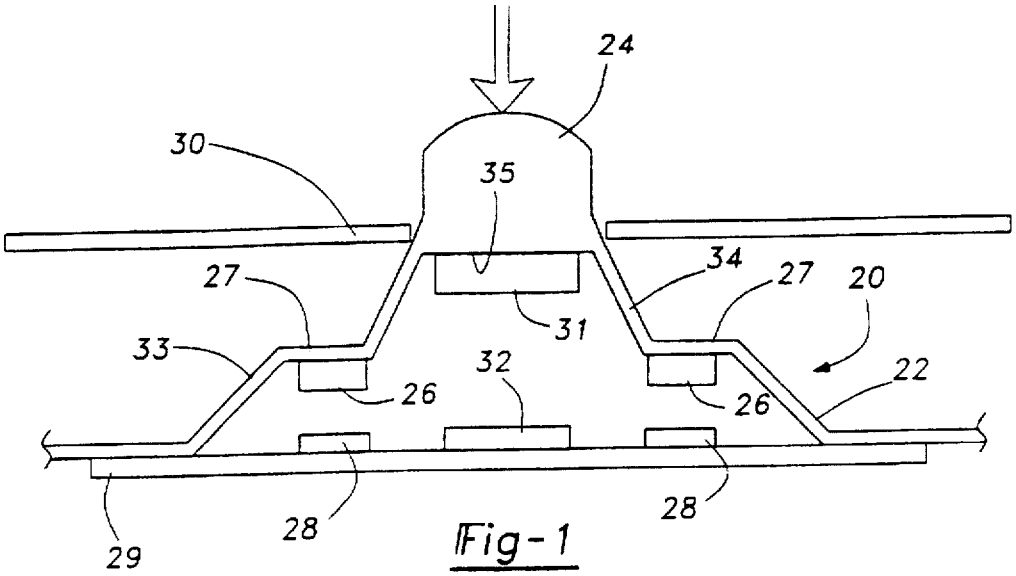
FIG. 1 is a view of the inventive multiple detent membrane switch.

An inventive multiple detent membrane switch 20 is illustrated in FIG. 1. A membrane 22 is formed with a button face 24. A first contact 26 is positioned on a first planar portion 27 of the membrane 22. The contact 26 is positioned above contact members 28 formed on a circuit board 29. The button 24 extends through a housing 30, shown here schematically, and is accessible to an operator of a vehicle or other system which carries the membrane switch 20. Other types of linkages may connect an operator switch to the button 24 to allow an operator to move the button.

A second contact 31 is positioned on a planar face 35 on membrane 22, and spaced from contacts 32 formed on circuit board 29. Contact 31 is preferably placed on a centerline of the button face 24. A first flexing area 33 is positioned radially outwardly of the contact 26, and a second flexing area 34 is positioned radially between contact 31 and contact 26.

The inventive switch is able to control two circuits with a minimum of parts. The contacts are shown somewhat schematically, and it should be understood that the contacts 32 and 28 would complete a circuit when contacted by the contacts 31 and 26, respectively.

Figure 2:
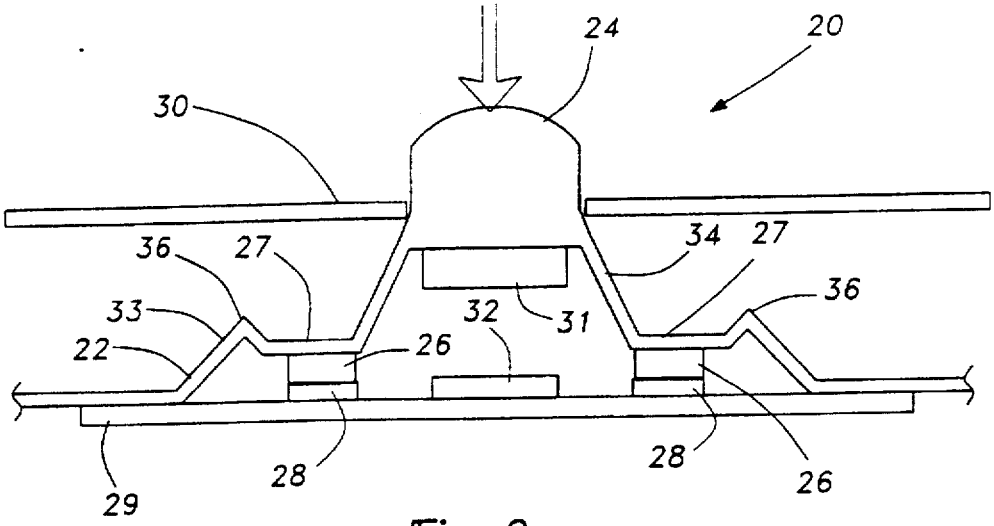
FIG. 2 shows the switch of FIG. 1 with a first circuit closed.

FIG. 2 shows the first circuit closed by the inventive switch 20. As shown, button 24 has been pressed inwardly relative to the housing 30. Contact member 26 is moved into contact with the contact 28. The flexing portion 33 has flexed into its flexed position 36. A first, lower insertion force is required to achieve this position. The design and manufacture of flexing portion 33 that can move to a flex position 36 such as shown in this figure, is within the skill of a worker in the membrane switch art. Single detent membrane switches have been developed, and the known flexing technology utilized there is sufficient for purposes of this invention. As shown in FIG. 2, contacts 31 and 32 remain out of contact, and thus the second circuit is not complete.

Should the operator desire to complete the second circuit, the button 24 is pressed further inwardly. The flexing portion 34 moves to its flexed orientation 38, and the contact 31 now contacts contact 32. The second circuit is now completed.

Figure 3:
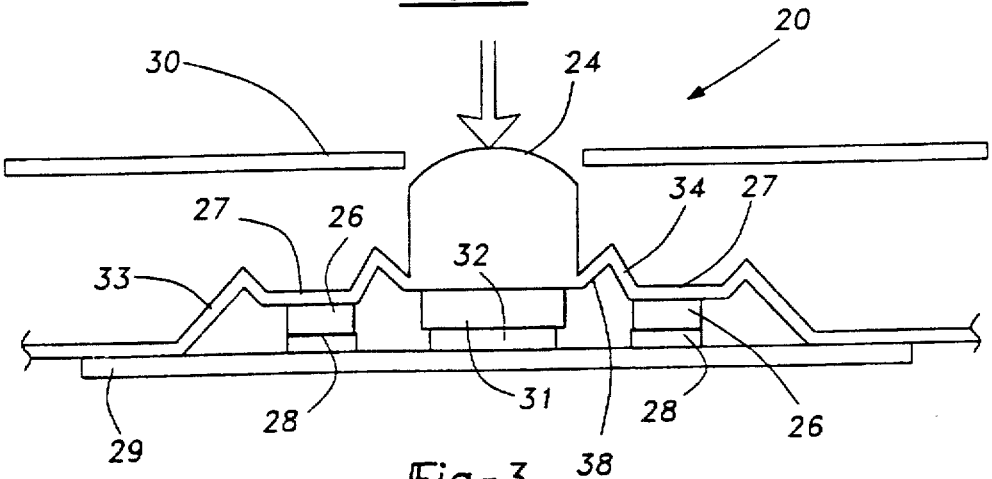
FIG. 3 shows the switch of the present invention with both circuits closed.

The operator is provided with a clear indication of the completion of the first detent as shown at FIG. 2, and knows to stop insertion if it is not desired to complete the second circuit. At the same time, the operator is also provided with a clear indication of when the second detent is completed to complete the second circuit. The switch 20 maintains the position shown in FIGS. 2 and 3 until the button 24 is released. Once released, the flexing areas return the switch to the FIG. 1 orientation.

As one example of a potential use for the inventive switch, the first detent and circuit can be utilized to generate a window to fully closed or open positions. The second circuit could be utilized to provide an indication that the operator would like the window movement to stop at an intermediate location. The use of the single membrane switch provides this dual switching ability with a minimum of parts and complexity for the required switching elements.

It is preferred that the arrangement of the switch be as shown in this drawing. The contacts 26 may be a generally cylindrical rings or may be circumferentially spaced contacts. The first flexing portion 33 is radially outwardly of the first contact 26. The second flexing portion 34 is radially between the first contact 26 and the second contact 31. The second contact 31 is radially inwardly of the first contact 26.

Preferred embodiments of this invention have been disclosed, however, a worker of ordinary skill in the art would recognize that certain modifications will come within the scope of this invention. For that reason, the following claims should be studied to determine the true scope and content of this invention.

I claim:

1. A membrane switch comprising:

a membrane body having at least first and second flexing portions and at least first and second membrane contact members, said membrane body positioned adjacent circuit electric contact members associated with each of said first and second membrane contact members on said membrane body;

said first and second flexing portion normally biasing said first and second membrane contact members out of contact with said associated circuit electric contact members, and a force on said membrane switch first flexing said first flexing portion and causing said first membrane contact member to contact said associated circuit electric contact, said first membrane contact member contacting said associated circuit electric contact and causing actuation of a vehicle component to move in a first manner, and further insertion force causing said second flexing portion to flex and allow said second membrane contact member to contact its associated switch contact member said second membrane contact member contacting said associated switch contact member and causing a vehicle component to be actuated to move in a second manner which is distinct from said first manner; and said second flexing portion requiring a greater insertion force to flex than said first flexing portion such that said first flexing portion moves initially to allow said first membrane contact to contact its associated circuit contact member.

2. A membrane switch as recited in claim 1, wherein said second membrane contact member is positioned radially inwardly of said first membrane contact member.

3. A membrane switch as recited in claim 2, wherein said first flexing area is radially outward of said first membrane contact member.

4. A membrane switch as recited in claim 3, wherein said second flexing area is radially between said first and second membrane contact members.

5. A membrane switch as recited in claim 1, wherein a button face is formed on said membrane body in a generally central location, said button face providing an operator with a location to apply an insertion force.

6. A membrane switch as recited in claim 5, wherein said second membrane contact member is aligned with a center of said button face.

7. A membrane switch as recited in claim 1, wherein said circuit electric contact members are mounted on a circuit board.

8. A membrane switch as recited in claim 1, wherein the vehicle component is a vehicle window.

9. A method of switching comprising the steps of:

providing a membrane switch having a first and second flexing portion and a first and second membrane electric contact, said membrane switch being positioned adjacent a circuit board, said circuit board being provided with associated circuit electric contacts for each of said first and second membrane contacts electric;

providing an insertion force on said membrane to overcome said first flexing portion and cause said first membrane contact member to contact said associated circuit contact, said first membrane contact member contacting said associated contact member and causing a vehicle component to move in a first manner;

providing further insertion force to overcome said second flexing area and cause said second membrane contact member to move into contact with said associated circuit contact on said circuit board, said second membrane contact member contacting its associated circuit contact and causing said vehicle component to move in a second manner which is distinct from said first manner.

10. A method as recited in claim 9, wherein the vehicle component is a vehicle window.

11. A method as recited in claim 10, wherein the actuation of said first membrane contact causing said window to move in a first manner is used to move a window to be fully closed or fully opened, and the actuation of a second membrane contact member to cause the window to move in a second manner is utilized to allow an operator to stop the movement at an intermediate position by releasing said switch.

12. A method as recited in claim 9, wherein said second flexing portion requiring a greater insertion force to flex in said first flexing portion such that said first flexing portion first moves to allow said first membrane contact to contact its associated circuit contact member.

13. A membrane switch as recited in claim 12, wherein the actuation of said first membrane contact causing said window to move in a first manner is used to move a window to be fully closed or fully opened, and the actuation of a second membrane contact member to cause the window to move in a second manner is utilized to allow an operator to stop the movement at an intermediate position by releasing said switch.

14. A membrane switch comprising:

a membrane body having a first flexing portion positioned radially outwardly of a second flexing portion and a first electric membrane contact member positioned radially between said first and second flexing portions, a second electric membrane contact member positioned radially inwardly of said second flexing portion;

a circuit board having first and second electric circuit contact members associated with said first and second electric membrane contact members, and positioned adjacent said membrane body, said first and second membrane contact members being normally biased away from said first and second circuit contact members by said flexing portions, and said first and second flexing portions having distinct insertion forces required to cause flexing such that upon the application of a first lower force, said first flexing portion is overcome and causes said first electric membrane contact member to move into contact with said first electric circuit contact, said first electric membrane contact contacting said first electric circuit contact causing a vehicle component to move in a first manner, while said second flexing portion still maintains said second electric membrane contact out of contact with said second electric circuit contact, and a further insertion force causing said second flexing portion to also flex and cause said second electric membrane contact member to contact said second electric circuit contact, said second electric membrane contact member contacting said second electric circuit contact causing the vehicle component to move in a second manner which is distinct from said first manner.

15. A membrane switch as recited in claim 14, wherein the actuation of said first membrane contact causing said window to move in a first manner is used to move a window to be fully closed or fully opened, and the actuation of a second membrane contact member to cause the window to move in a second manner is utilized to allow an operator to stop the movement at an intermediate position by releasing said switch.

16. A membrane switch as recited in claim 14, wherein the vehicle component is a vehicle window.

* * * * *